US010166556B2

(12) United States Patent
Buckner

(10) Patent No.: US 10,166,556 B2
(45) Date of Patent: Jan. 1, 2019

(54) PULSATING HIGH PRESSURE AIR AND WATER NOZZLE

(75) Inventor: Don M. Buckner, Okahumpka, FL (US)

(73) Assignee: VAC-TRON EQUIPMENT, LLC, Okahumpka, FL (US)

( * ) Notice: Subject to any disclaimer, the term of this patent is extended or adjusted under 35 U.S.C. 154(b) by 781 days.

(21) Appl. No.: 13/568,390

(22) Filed: Aug. 7, 2012

(65) Prior Publication Data

US 2014/0042246 A1 Feb. 13, 2014

(51) Int. Cl.
*B05B 3/06* (2006.01)
*B05B 3/04* (2006.01)
*B08B 3/02* (2006.01)

(52) U.S. Cl.
CPC ..... *B05B 3/06* (2013.01); *B05B 3/04* (2013.01); *B08B 3/02* (2013.01)

(58) Field of Classification Search
CPC ..... B05B 3/06; B05B 3/04; B08B 3/02
USPC ..... 239/381–383, 101
See application file for complete search history.

(56) References Cited

U.S. PATENT DOCUMENTS 1,906,382 A 11/1931 Keys
2,198,021 A 4/1940 Wood
2,639,601 A 5/1953 Miller
3,473,736 A * 10/1969 Heitzman ..... 239/101
3,864,064 A 2/1975 Gannaway
3,963,179 A * 6/1976 Tomaro ..... 239/101
4,079,891 A * 3/1978 Kwan ..... 239/381
4,111,278 A 9/1978 Bergman
4,119,238 A 10/1978 Ja'Afar
4,203,550 A * 5/1980 On ..... 239/381
4,209,132 A * 6/1980 Kwan ..... 239/381
4,334,633 A 6/1982 Piegza
4,744,698 A 5/1988 Dallimer
4,760,656 A 8/1988 East
5,092,963 A 3/1992 Barker
5,169,072 A * 12/1992 Gulyas ..... 239/381
5,191,993 A 3/1993 Wanger
5,196,654 A 3/1993 Diflora
5,248,092 A 9/1993 Rankin
5,500,976 A 3/1996 Rohrbacher
5,515,625 A 5/1996 Keigley
5,573,371 A 11/1996 Kieffer
5,862,985 A * 1/1999 Neibrook et al. ..... 239/99
5,887,667 A 3/1999 Van Zante
(Continued)

*Primary Examiner* — Chee-Chong Lee
(74) *Attorney, Agent, or Firm* — Matthew G. McKinney, Esq.; Allen, Dyer et al.

(57) ABSTRACT

A pulsating high pressure air and water nozzle is disclosed. The nozzle includes an impeller adapted to rotate about an axis, a housing adapted to secure the impeller therein, and a supply conduit secured to the housing. The supply conduit is orientated to direct a stream of pressurized fluid to impact the impeller to cause the impeller to rotate. The nozzle also includes a discharge port secured to the housing and is adapted to discharge a pulsating stream of fluid directly from the housing. The impeller includes a plurality of radial spaced vanes secured to a hub, where a cavity is disposed between each vane of the plurality of vanes. The plurality of vanes is adapted to intermittently block the discharge port as the impeller rotates. In addition, the nozzle includes a cover adapted to be removably secured to the housing to access an inside of the housing.

8 Claims, 3 Drawing Sheets

(56) References Cited

U.S. PATENT DOCUMENTS

| | | | | |
|---|---|---|---|---|
| 5,996,731 | A | 12/1999 | Czabala | |
| D423,521 | S | 4/2000 | Walter | |
| 6,360,458 | B2 | 3/2002 | Dolister | |
| 6,397,967 | B1 | 6/2002 | McIiwraith | |
| 6,499,934 | B1 | 12/2002 | Kaczmarski | |
| 6,533,064 | B1 | 3/2003 | Kim | |
| 6,550,406 | B2 | 4/2003 | Bass | |
| 6,604,304 | B1 | 8/2003 | Slabach | |
| 6,988,568 | B2 | 1/2006 | Buckner | |
| 7,484,322 | B2 | 2/2009 | Maybury, Jr. | |
| 7,837,050 | B2 | 11/2010 | Maybury, Jr. | |
| 8,066,140 | B1 | 11/2011 | Young | |
| 8,336,231 | B2 | 12/2012 | Marbury | |
| 2002/0005877 | A1 | 1/2002 | Silverbrook | |
| 2006/0032095 | A1 | 2/2006 | Buckner | |
| 2006/0117612 | A1 | 6/2006 | Maybury, Jr. | |
| 2006/0182591 | A1 | 8/2006 | Hackett | |
| 2010/0320204 | A1 | 12/2010 | Maybury, Jr. | |
| 2011/0088289 | A1 | 4/2011 | Maybury, Jr. | |
| 2012/0181353 | A1* | 7/2012 | Zhou et al. | 239/101 |

* cited by examiner

FIG. 1
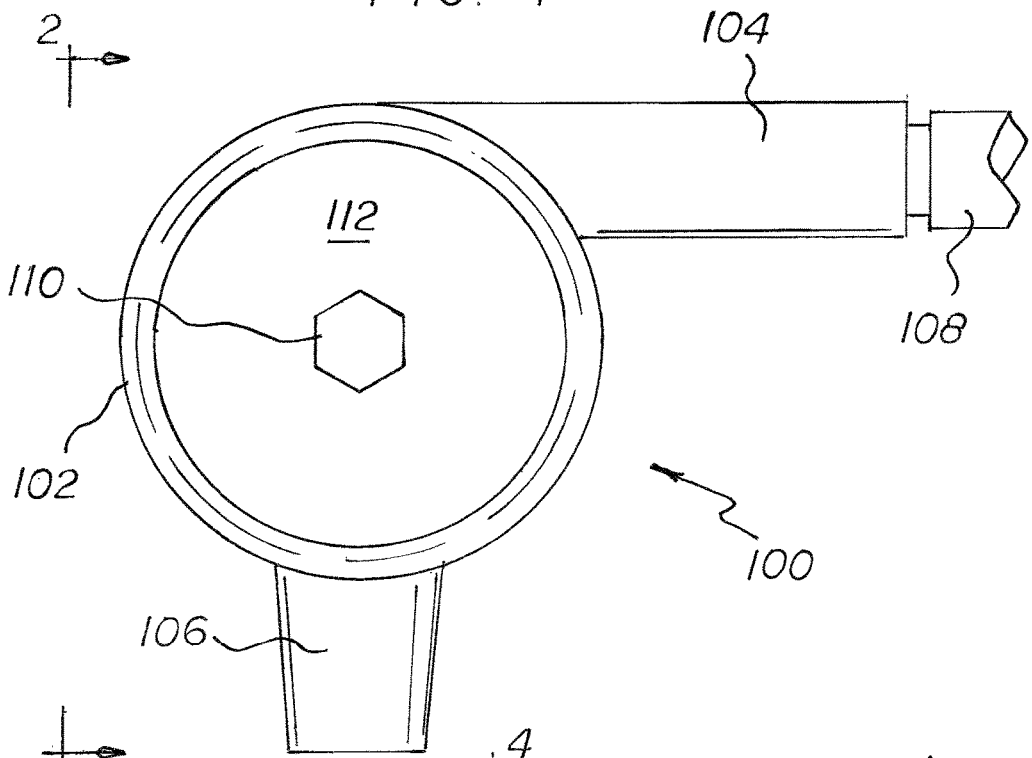
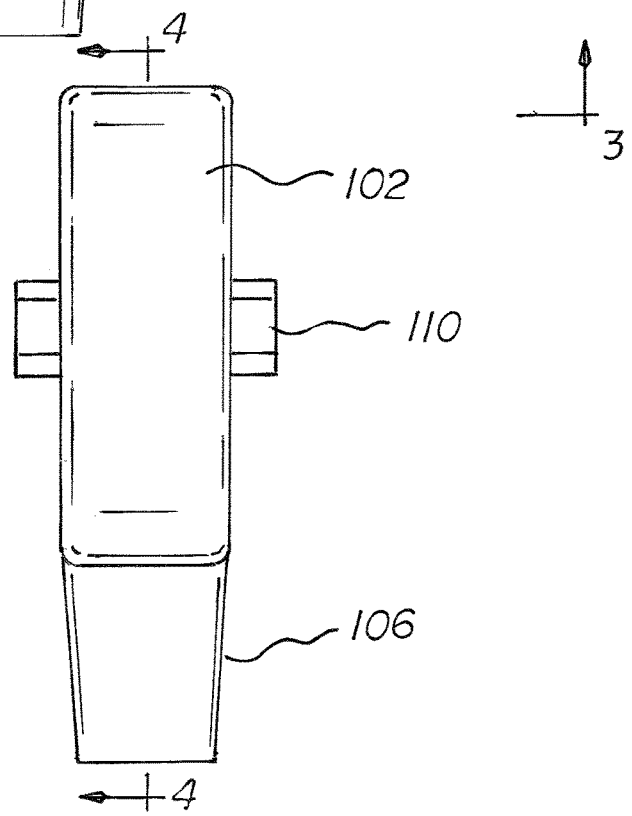
FIG. 2

FIG. 3
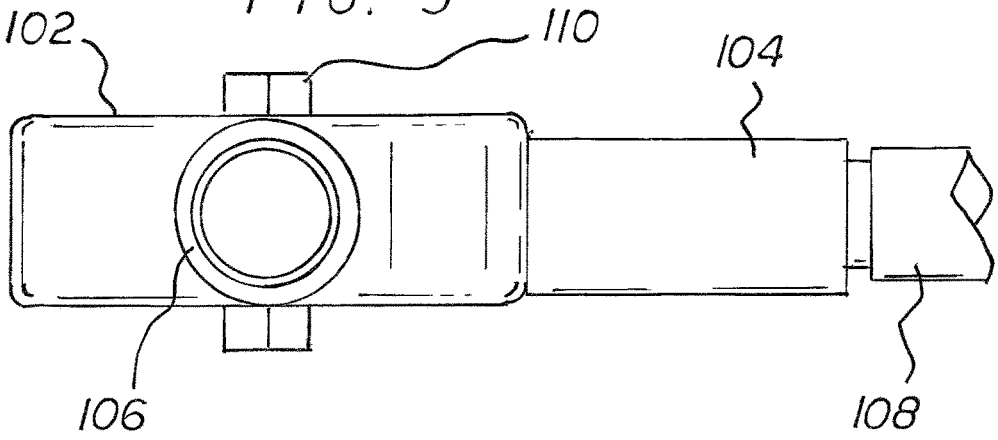
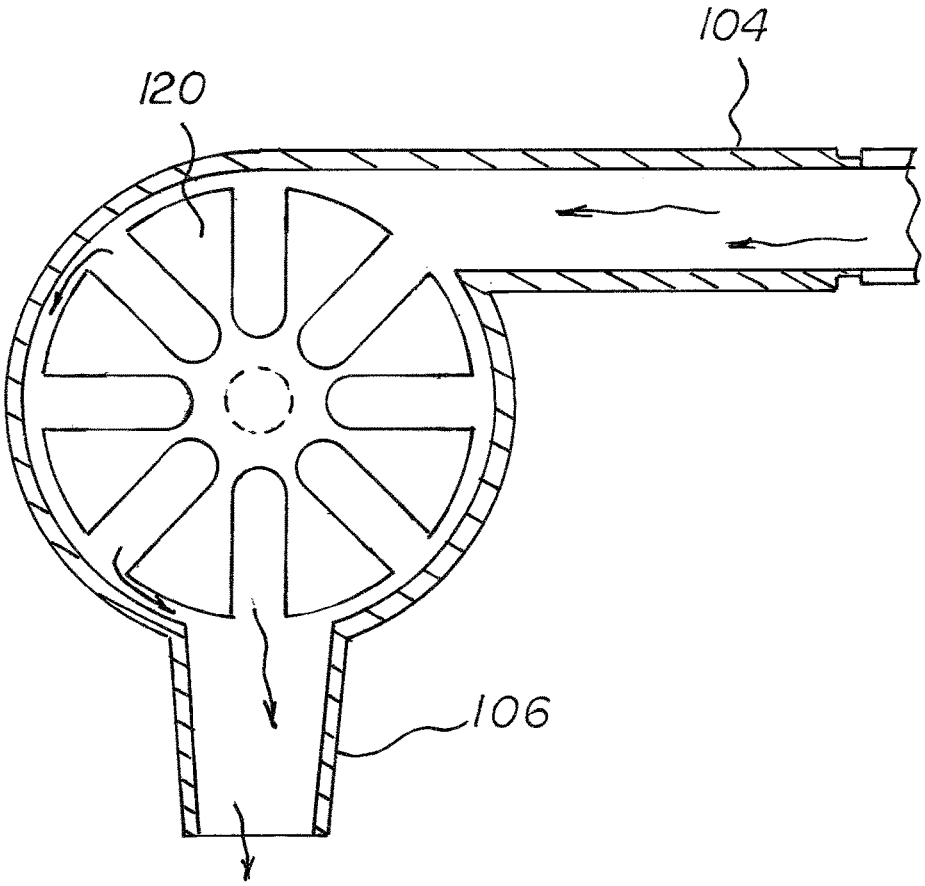
FIG. 4

PULSATING HIGH PRESSURE AIR AND WATER NOZZLE

I. FIELD OF THE INVENTION

The present invention relates generally to a pulsating high pressure air and water nozzle.

II. BACKGROUND

Industrial vacuum equipment has dozens of wet and dry uses such as locating underground utilities (potholing), hydro excavation, air excavation and vacuum excavation. In addition, the equipment can be used for directional drilling slurry removal, industrial clean-up, waste clean-up, lateral and storm drain clean-out, oil spill clean-up and other natural disaster clean-up applications, signs and headstone setting, for example.

Often times high pressure air and water nozzles can be used in conjunction with the vacuum equipment to assist in dislodging material for collection by the vacuum equipment. For example, there are pressure washers that include a complement of different sized nozzles. Some nozzles cause the water jet to be discharged in a triangular plane such as a fan pattern, while others discharge a thin jet of water, which spirals around rapidly in a cone pattern. Other prior art nozzles use a rotor within a chamber that is susceptible to being easily broken, clogged and is difficult to clean.

Most nozzles attach directly to some type of wand or gun. The pressure washer adds its own power to create higher pressure and velocity. However, these prior art pressure washers typically operate at relatively low flow rates and pressures than required for industrial applications such as part cleaning, hydro-excavation, and boring.

Specialized industrial nozzles that have been developed to handle high flow rates do not generate a dynamic and rotating flow pattern. For example, high pressure nozzles that are used for cleaning industrial parts, deburring industrial parts and the like typically discharge at pressures of several thousand pounds per square inch (psi). A shortcoming of these previously known nozzles, however, is that the nozzles are of a fixed geometry and do not generate a dynamic flow pattern. In addition, when the nozzles are switched from one type of nozzle for one application to a different nozzle, it is necessary to employ cumbersome fluid couplings to ensure fluid tight connections with the nozzle. Another shortcoming of the prior art is the inefficiency and difficulty to excavate using a vacuum hose in hard subsurface conditions. Accordingly, what is needed is a pulsating high pressure air and water nozzle that is efficient in all subsurface conditions to help dislodge material for collection by vacuum equipment.

III. SUMMARY

The following presents a simplified summary of one or more embodiments in order to provide a basic understanding of some aspects of such embodiments. This summary is not an extensive overview of the one or more embodiments, and is intended to neither identify key or critical elements of the embodiments nor delineate the scope of such embodiments. Its sole purpose is to present some concepts of the described embodiments in a simplified form as a prelude to the more detailed description that is presented later.

In a particular embodiment, a pulsating high pressure air and water nozzle is disclosed. The nozzle includes an impeller adapted to rotate about an axis, a housing adapted to secure the impeller therein, and a supply conduit secured to the housing. The supply conduit is orientated to direct a stream of pressurized fluid to impact the impeller to cause the impeller to rotate, and a discharge port secured to the housing adapted to discharge a pulsating stream of fluid directly from the housing. The impeller further includes a plurality of radial spaced vanes secured to a hub, where a cavity is disposed between each vane of the plurality of vanes. Each cavity is adapted to collect fluid from the supply port and to transport the fluid around an interior of the housing to the discharge port as the impeller rotates. The plurality of vanes is adapted to intermittently block the discharge port as the impeller rotates. In addition, the nozzle includes a cover adapted to be removably secured to the housing to access an inside of the housing and the impeller. The impeller is adapted to be removed from the housing and replaced with a desired new impeller by removing the cover. Further, the nozzle includes a top stud projecting from an upper surface of the hub, and a bottom stud projecting from a lower surface of the hub, where the top stud and the bottom stud are each adapted to engage a respective countersunk conical receptacle in the housing for rotation of the impeller. A gasket maintains a watertight connection between the cover and the housing. The pressurized fluid may be water, air, or any combination thereof.

In another particular embodiment, the nozzle includes an impeller adapted to rotate about an axis, an annular housing adapted to secure the impeller therein, a supply aperture, where the supply aperture is orientated to direct a stream of pressurized fluid to impact the impeller to cause the impeller to rotate, a discharge port secured to the housing and adapted to discharge a pulsating stream of fluid. The impeller includes a plurality of radial spaced vanes, where the plurality of vanes is adapted to intermittently block the discharge port as the impeller rotates. A cavity is disposed between each vane of the plurality of vanes. In addition, the annular housing includes a threaded access opening and a threaded cover adapted to engage the threaded access opening for removably securing the cover to the housing. The impeller is adapted to be removed from the housing and replaced with a desired replacement impeller by removing the cover. Each vane of the impeller may be triangular shaped to form a cavity between each vane.

In another particular embodiment, a pulsating nozzle is disclosed that includes a housing to secure an impeller, where the impeller is adapted to intermittently interrupt a stream of pressurized fluid to impart a pulsating effect when the fluid is discharged from the housing. A supply port directs the stream to the impeller to cause the impeller to rotate within the housing. The nozzle also includes a discharge port for the fluid to exit the housing when discharged. The impeller is adapted to intermittently block at least a portion of the discharge port when rotating and the impeller is adapted to be removed and replaced. The nozzle is adapted to be used with high pressure fluid that may have a pressure of more than 1,500 pounds per square inch.

To the accomplishment of the foregoing and related ends, one or more embodiments comprise the features hereinafter fully described and particularly pointed out in the claims. The following description and the annexed drawings set forth in detail certain illustrative aspects and are indicative of but a few of the various ways in which the principles of the embodiments may be employed. Other advantages and novel features will become apparent from the following detailed description when considered in conjunction with the drawings and the disclosed embodiments are intended to include all such aspects and their equivalents.

IV. BRIEF DESCRIPTION OF THE DRAWINGS

FIG. 1 is a right side elevational view of a particular embodiment of a pulsating high pressure air and water nozzle;

FIG. 2 is a front view of the nozzle shown in FIG. 1 taken along line 2-2;

FIG. 3 is a bottom view of the nozzle taken along line 3-3;

FIG. 4 is a cross sectional view of the nozzle taken along 4-4 of FIG. 2.

V. DETAILED DESCRIPTION

Figure 5:
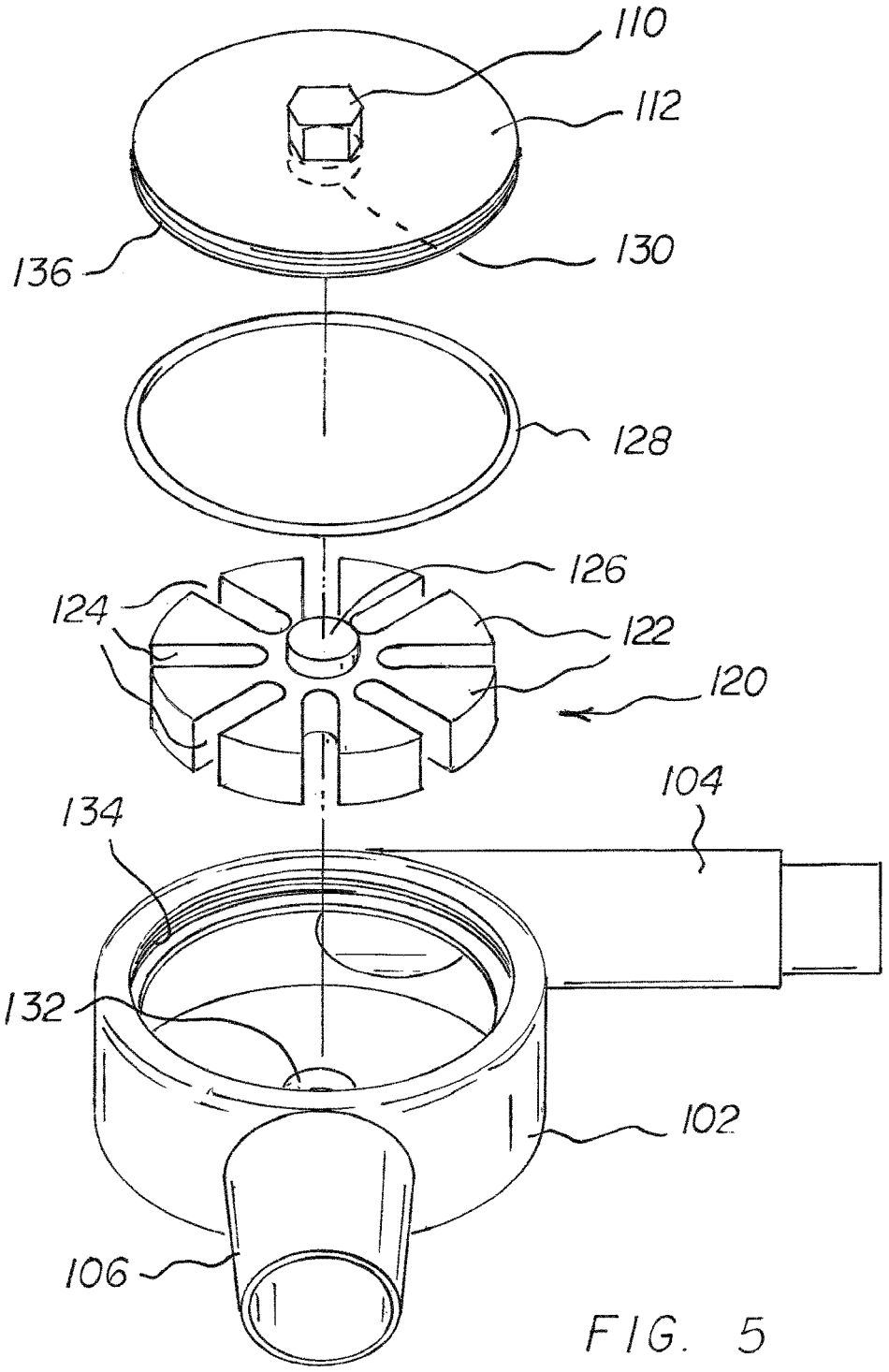
FIG. 5 is a perspective exploded view of the particular embodiment of the pulsating high pressure air and water nozzle.

The word "exemplary" is used herein to mean "serving as an example, instance, or illustration." Any embodiment or design described herein as "exemplary" is not necessarily to be construed as preferred or advantageous over other embodiments or designs.

Referring to FIGS. 1-3, a particular illustrative embodiment of a pulsating high pressure air and water nozzle is disclosed. The nozzle 100 may be used with pressures of up to several thousand pounds per square inch and high flow rates. For example, the pressure of the fluid entering the nozzle 100 may be more than 1,500 pounds per square inch. The pressurized fluid may be water, air, or any combination thereof. The fluid can also include media or a detergent. The nozzle 100 includes a housing 102 that is adapted to secure an impeller inside. The housing 102 may be annular in shape and an interior of the housing corresponds with the size of the impeller secured and seated inside. A supply conduit 104 is in fluid communication with a pressurized fluid source 108 to provide the fluid to the housing 102. The supply conduit 104 is orientated to the housing 102 such that the fluid entering the housing is not directed to the center of the housing but rather somewhat tangentially to assist the impeller 120 to rotate. A removable cover 112 is secured to the housing 102. A nut 110 or other securement means may be used to secure the cover 112 to the housing 102. A discharge port 106 is secured to the housing 102 and is adapted to discharge a pulsating stream of fluid directly from the housing 102. Accordingly, the pressurized fluid enters the housing 102 through supply port 104, and exits the housing 102 through discharge port 106 as a pulsating stream of fluid. The discharge port 106 is shown in this particular embodiment as being approximately 90 degrees relative to the supply port 104. However, the discharge port 106 may be placed anywhere along the housing including substantially aligned with the supply port 104 as long as the impeller 102 (described below) is adapted to intermittently interrupt the flow of the stream of fluid entering the housing 102.

As shown in FIG. 4 in a cross sectional view taken along line 4-4 of FIG. 2, the impeller 120 is concentrically placed within the housing 102. The supply port 104 is orientated so that the pressurized fluid enters the housing 102 and is directed tangentially to the impeller 120. The impeller 120 is adapted to rotate about an axis within the housing 102. The impact of the fluid on the impeller 120 causes the impeller to rotate. In this particular embodiment, the fluid travels counter-clockwise around the housing 102. The rotating impeller 120 collects and discharges in sections creating discharges that pulse, thus creating mini shock waves to help dislodge material for collection by vacuum.

Referring now to FIG. 5 of an exploded view of a particular embodiment of the nozzle 100, the impeller 120 is disc shaped and includes a plurality of radial spaced vanes 122 secured to a hub 126. The impeller 120 may be fabricated using injection molding, a milling process, or other fabrication methods. The impeller 120 may be manufactured as one continuous element or fabricated from multiple pieces. A cavity 124 is disposed between each vane 122 and fills with fluid by the supply port 104 and discharges through the discharge port 106. The vanes 122 are adapted to intermittently block the discharge port 106 as the impeller 120 rotates. The vanes 122 may completely or partially bock the discharge port 106 as the impeller 120 rotates. Accordingly, the continuous stream of fluid entering the housing 102 is interrupted intermittently by the impeller vanes 122 thereby imparting impulses to the stream of fluid.

The cover 112 is adapted to be removably secured to the housing 102 to access an inside of the housing 102 and the impeller 120. An O-ring or gasket 128 may be used to maintain a watertight connection between the cover 112 and the housing 102. The housing 102 may include a threaded access opening 134. Likewise, the cover 112 may have threading 136 adapted to engage the threaded access opening 134 for removably securing the cover 112 to the housing 102. Alternatively, the cover 112 may not be adapted to be removed and sealed permanently to the housing 102.

In a particular embodiment, the impeller 120 is adapted to be easily removed from the housing 102 and replaced with a desired new impeller by removing the cover 112. The shape or size of the impeller 120 will affect the pulsating stream of fluid. For example, each vane 122 may triangular shaped to form the cavity 124 between each vane 122. The vanes 122 may be rectangular, curved, or any combination thereof. In addition, the number of vanes 122 may be adjusted to affect the discharge steam. For example, more vanes 122 will impart quicker, smaller pulses to the stream of fluid. Whereas less vanes 122 will impart less impulses per revolution of the impeller 120. Similarly, adjusting the size of the cavities 124 will affect the size (i.e., flow) of the impulses of fluid. For example, a larger section of cavity 124 will generate more volume to each impulse of fluid per revolution of the impeller 120 and a smaller cavity 124 will generate a smaller impulse flow per revolution of the impeller 120.

The impeller 120 may be secured in the housing using different means. For example, the impeller 120 may have a top stud projecting from an upper surface of a central part of the impeller 120 and a bottom stud projecting from a lower surface of the impeller 120. The bottom stud is similar to the top stud 126. Both the top stud and the bottom stud are each adapted to engage a respective countersunk conical receptacle 130, 132 for rotation of the impeller 120. In particular, the top stud is adapted to rotate within a conical receptacle 130 that is formed within the cover 112 and the bottom stud is adapted to rotate within a conical receptacle 132 that is formed within the housing 102. Thus, the impeller 120 has two bearing points about which the impeller 120 may freely rotate. The impeller 120 is adapted to intermittently interrupt a stream of pressurized fluid to impart a pulsating effect when the fluid is discharged from the housing 102. The impeller 120 is adapted to intermittently block at least a portion of the discharge port 106 when rotating. The particular application will determine the configuration of the impeller 120. The impeller 120 can be easily removed from the housing 102 and replaced. The pressure of the fluid entering the supply port may be more than 1,500 pounds per square inch.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

The Abstract of the Disclosure is provided to comply with 37 C.F.R. § 1.52(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

What is claimed is:

1. A pulsating nozzle, the nozzle comprising:

an impeller adapted to rotate about an axis;

an annular housing securing the impeller therein;

a supply aperture secured to the annular housing, wherein the supply aperture is orientated to direct a stream of pressurized fluid to impact the impeller; and a discharge port secured to the annular housing to discharge a pulsating stream of fluid;

the impeller comprising a plurality of radial spaced vanes positioned to cause the impeller to rotate by the stream of pressurized fluid, wherein the plurality of vanes is configured to intermittently block the discharge port as the impeller rotates to generate the pulsating stream of fluid; and a cavity formed between each vane of the plurality of vanes, wherein each cavity having an opening and a closed bottom to fill the respective cavity with a volume of the pressurized fluid at the supply aperture and to discharge the volume of pressurized fluid back through the opening at the discharge port.

2. The nozzle of claim 1, the annular housing further comprising a threaded access opening.

3. The nozzle of claim 2, further comprising a threaded cover adapted to engage the threaded access opening for removably securing the cover to the housing.

4. The nozzle of claim 3, wherein the impeller is adapted to be removed from the housing and replaced with a desired replacement impeller by removing the cover.

5. The nozzle of claim 4, wherein the pressurized fluid is water, air, or any combination thereof.

6. The nozzle of claim 5, further comprising a gasket to maintain a watertight connection between the cover and the housing.

7. The nozzle of claim 1, wherein each vane is triangular shaped to form the cavity between each vane.

8. The nozzle of claim 1, wherein the stream of pressurized fluid configured to enter the supply aperture at a pressure of more than 1,500 pounds per square inch.

* * * * *